US011454228B2

(12) United States Patent
Huang et al.

(10) Patent No.: US 11,454,228 B2
(45) Date of Patent: Sep. 27, 2022

(54) HAND AIR PUMP HANDLE ASSEMBLY AND HAND AIR PUMP

(71) Applicant: BESTWAY INFLATABLES & MATERIAL CORP., Shanghai (CN)

(72) Inventors: Shuiyong Huang, Shanghai (CN); Yalan Chen, Shanghai (CN); Wanbin Qiu, Shanghai (CN)

(73) Assignee: BESTWAY INFLATABLES & MATERIAL CORP., Shanghai (CN)

( * ) Notice: Subject to any disclaimer, the term of this patent is extended or adjusted under 35 U.S.C. 154(b) by 0 days.

(21) Appl. No.: 16/883,599

(22) Filed: May 26, 2020

(65) Prior Publication Data

US 2020/0378376 A1 Dec. 3, 2020

(30) Foreign Application Priority Data

May 27, 2019 (CN) ..... 201920767603.2

(51) Int. Cl.
*F04B 33/00* (2006.01)
*F04B 39/00* (2006.01)

(52) U.S. Cl.
CPC ..... *F04B 33/00* (2013.01); *F04B 39/00* (2013.01)

(58) Field of Classification Search
CPC ..... F04B 33/00; F04B 33/005; F04B 39/00
See application file for complete search history.

(56) References Cited

U.S. PATENT DOCUMENTS 3,888,127 A * 6/1975 Shamlian ..... G01L 7/043 73/431
5,335,543 A * 8/1994 Hermansen ..... B63C 11/02 73/291
6,485,264 B1 * 11/2002 Wu ..... F04B 33/005 417/63
8,721,296 B1 5/2014 Wang
2018/0010592 A1 * 1/2018 Chuang ..... F04B 51/00

FOREIGN PATENT DOCUMENTS

DE 102015106355 6/2016
GB 251721 5/1926

OTHER PUBLICATIONS

Extended European Search Report, dated Sep. 28, 2020 (dated Sep. 28, 2020) on related European Patent Application 20174750.8 by the European Paten Office.
Extended European Search Report, dated Sep. 28, 2020 (dated Sep. 28, 2020) on related European Patent Application No. 20174750.8 by the European Paten Office.

* cited by examiner

*Primary Examiner* — Connor J Tremarche
(74) *Attorney, Agent, or Firm* — Dickinson Wright PLLC

(57) ABSTRACT

Embodiments of the present invention include a hand air pump handle assembly and a hand air pump, including a pressure gauge elastically attached thereto. The hand air pump handle assembly comprises a handle shell that defines an accommodating space for placement of the pressure gauge. The accommodating space is provided with an air vent for connecting the accommodating space to an inflatable body, such as an inflatable mattress. The pressure gauge measures an internal air pressure for the inflatable body via the air vent and is connected to the handle shell with an elastic connector. The elastic connector can elastically deform to prevent the pressure gauge from being damaged or broken under external forces such as an impact.

19 Claims, 6 Drawing Sheets

HAND AIR PUMP HANDLE ASSEMBLY AND HAND AIR PUMP

CROSS-REFERENCE TO RELATED APPLICATION

This U.S. patent application claims priority to and the benefit of Chinese patent application number 201920767603.2, filed May 27, 2019, the entire disclosure of which is hereby incorporated by reference.

BACKGROUND OF THE INVENTION

1. Field of the Invention

The present disclosure relates to a hand air pump handle assembly with an internal pressure gauge and a hand air pump including the hand air pump handle assembly.

2. Related Art

This section provides background information related to the present disclosure which is not necessarily prior art.

Inflatable bodies (e.g., air mattresses, inflatable sofas, pneumatic tires and inflatable toys) need to be inflated with air before use. Depending on the inflatable body, the amount of inflation, as measured in units of pressure, generally needs to be relatively specific. Too much or too little inflation and the inflatable body can malfunction or break. Electric air pumps and hand air pumps are commonly used to inflate a large variety of inflatable bodies. Too help ensure that the inflatable body is inflated to an ideal pressure, pressure gauges (e.g., electronic and non-electronic pressure gauges) are sometimes mounted on air pump handles and provide current air pressure inside of the inflatable body as it is inflated.

While mounted pressure gauges have improved operability of certain air pumps, such mounted pressure gauges are generally directly and rigidly mounted onto the pump handle, and thus are susceptible to damage during misuse or an accident with the air pump. More particularly, pressure gauges mounted within air pump handles are not protected from potential damage from physical shock that may result from, for example, dropping the air pump. Generally, when a pressure gauge breaks, it is cheaper and/or more efficient to buy a new air pump rather than attempting to fix the old air pump by replacing the broken pressure gauge.

Accordingly, there is a need to improve the connection and implementation of a pressure gauge within an air pump handle, so that it is less susceptible to damage.

SUMMARY OF THE INVENTION

The following outlines certain features of embodiments of the present invention such that the detailed description of the invention that follows may be better understood. Additional features of embodiments of the present invention will be described hereinafter. It should be appreciated by those skilled in the art that the general concepts and the specific embodiments disclosed herein may be readily utilized as bases for modifying or designing other embodiments for carrying out the same or similar purposes of the present invention. It should also be realized by those skilled in the art that such equivalent embodiments do not depart from the spirit and scope of the invention, as set forth in the appended claims.

According to an aspect of the disclosure, a hand air pump handle assembly is provided. The hand air pump handle assembly comprises a handle shell defining an accommodating space and having an air vent in fluid communication with both the accommodating space and a provided inflatable body. A pressure gauge is located and elastically supported within the accommodating space. A flexible connecting tube is in the accommodating space of the handle shell and comprises a first end and a second end and a tube joint connecting the flexible connecting tube to the air vent.

In accordance with another aspect of the disclosure, the hand air pump handle assembly includes an elastic connector connecting the pressure gauge to the handle shell to permit movement of the pressure gauge within the accommodating space. The pressure gauge comprises a pressure gauge body and a pressure probe extending from the pressure gauge body and in fluid communication with the provided inflatable body through the flexible connecting tube.

According to another aspect of the disclosure, the elastic connector comprises a resisting member at least partially sleeved over an outer side of the flexible connecting tube. The resisting member comprises a support portion for supporting the pressure gauge body and a raised portion protruding radially inward along the support portion to contact the flexible connecting tube. The elastic connector further comprises a spring sleeved over the outer side of the flexible connecting tube and extending between a pair of ends thereof, wherein one end of the spring abuts against the raised portion of the resisting member, and the other end of the spring is fixed in an annular recess located around the air vent.

In accordance with another aspect of the disclosure, the flexible connecting tube extends between the first end and the second end. The first end of the flexible connecting tube is fixed between the raised portion of the resisting member and the pressure probe and the second end of the flexible connecting tube forms an interference fit with the tube joint. The pressure probe includes a threaded portion extending through the raised portion of the resistance member, and the flexible connecting tube fits between the threaded portion and the raised portion.

According to yet another aspect of the disclosure, the hand air pump handle assembly further includes at least a pair of cable ties, wherein one of the pair of cable ties affixes the first end of the flexible connecting tube to the pressure probe and the other one of the pair of cable ties affixes the second end of the flexible connecting tube to the tube joint.

According to yet another aspect of the disclosure, the hand air pump handle assembly further includes a fixing member affixing the tube joint to the handle shell. The tube joint further includes a protrusion located in the accommodating space that extends a diameter of the tube joint such that the diameter is larger than a diameter of the air vent and a seal washer located between the protrusion and the handle shell. The tube joint is at least partially threaded, and the fixing member includes a nut engaged thereon.

In accordance with another aspect of the disclosure, the hand air pump handle assembly further includes flexible shock absorber arranged between the pressure gauge and the handle shell for dampening impact between the handle shell and the pressure gauge. The flexible shock absorber comprises a shock absorber body at least partially covering the pressure gauge. The flexible shock absorber further comprises at least one shock absorber leg extending from the shock absorber body towards the handle shell to provide additional dampening. The hand air pump handle assembly further includes a holder for the flexible shock absorber fixed in the accommodating space for contacting the shock absorber leg and causing the shock absorber leg to move as the pressure gauge is moved. The flexible shock absorber may comprise a rubber member or a sponge-like material.

According to yet another aspect of the disclosure, the hand air pump handle assembly further includes the provided inflatable body, wherein the provided inflatable body comprises at least one of an inflatable sofa, an air mattress, an inflatable toy, or a pneumatic tire.

In accordance to another aspect of the disclosure, the hand air pump handle assembly further includes a cover that can be connected to and disconnected from the handle shell. The cover is at least partially transparent so that the pressure gauge can be viewed therethrough.

According to yet another aspect of the disclosure, the hand air pump handle assembly further includes a pair of grip portions extending from opposite sides of the handle shell. The handle shell and the pair of grip portions may be integrally formed.

BRIEF DESCRIPTION OF THE DRAWINGS

The drawings described herein are only for illustrative purposes of selected embodiments and are not intended to limit the scope of the present disclosure. The inventive concepts associated with the present disclosure will be more readily understood by reference to the following description in combination with the accompanying drawings wherein.

DESCRIPTION OF THE ENABLING EMBODIMENTS

Figure 1:
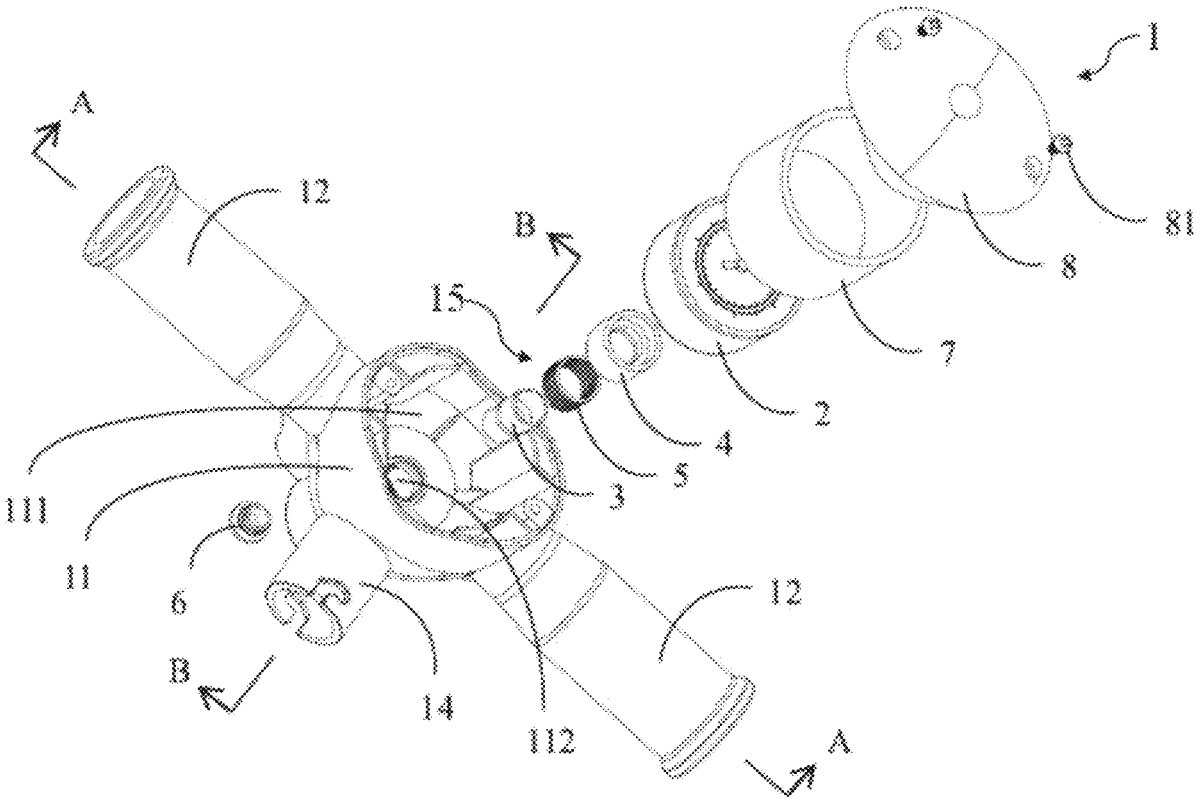
FIG. 1 is a disassembled top perspective view of a hand air pump handle assembly, according to a first embodiment of the present disclosure.

Exemplary embodiments will now be described more fully with reference to the accompanying drawings. In general, the subject embodiments are directed to a hand air pump handle assembly and an air pump with the handle assembly. However, the exemplary embodiments are only illustrative of the various features of the present invention, as those skilled in the art understand that various changes thereto may be made without departing from the full scope of the invention. Numerous specific details are set forth, such as examples of specific components, devices, and methods, to provide a thorough understanding of the embodiments of the present disclosure. It will be apparent to those skilled in the art that specific details need not be employed, that exemplary embodiments may be altered in many different forms and that neither should be construed to limit the scope of the disclosure. In some exemplary embodiments, well-known processes, well-known device structures, and well-known technologies are not described in detail. It is to be further noted that the accompanying drawings are not only intended to interpret the present invention, but also to help illustrate exemplary embodiments of the present invention, without limiting the full scope of the invention as set forth in the claims.

In the present description, the directional terms such as "top", "bottom", "upper" and "lower" are all confined according to the directions in which a hand air pump handle assembly is normally used, as shown in the drawings.

FIG. 1 to FIG. 5 schematically illustrate a first embodiment of a hand air pump handle assembly 1 according to the present disclosure. The hand air pump handle assembly 1 mainly comprises a handle shell 11 mounted with a pressure gauge 2, two grip portions 12, a first connector 13, and a second connector 14.

Figure 2:
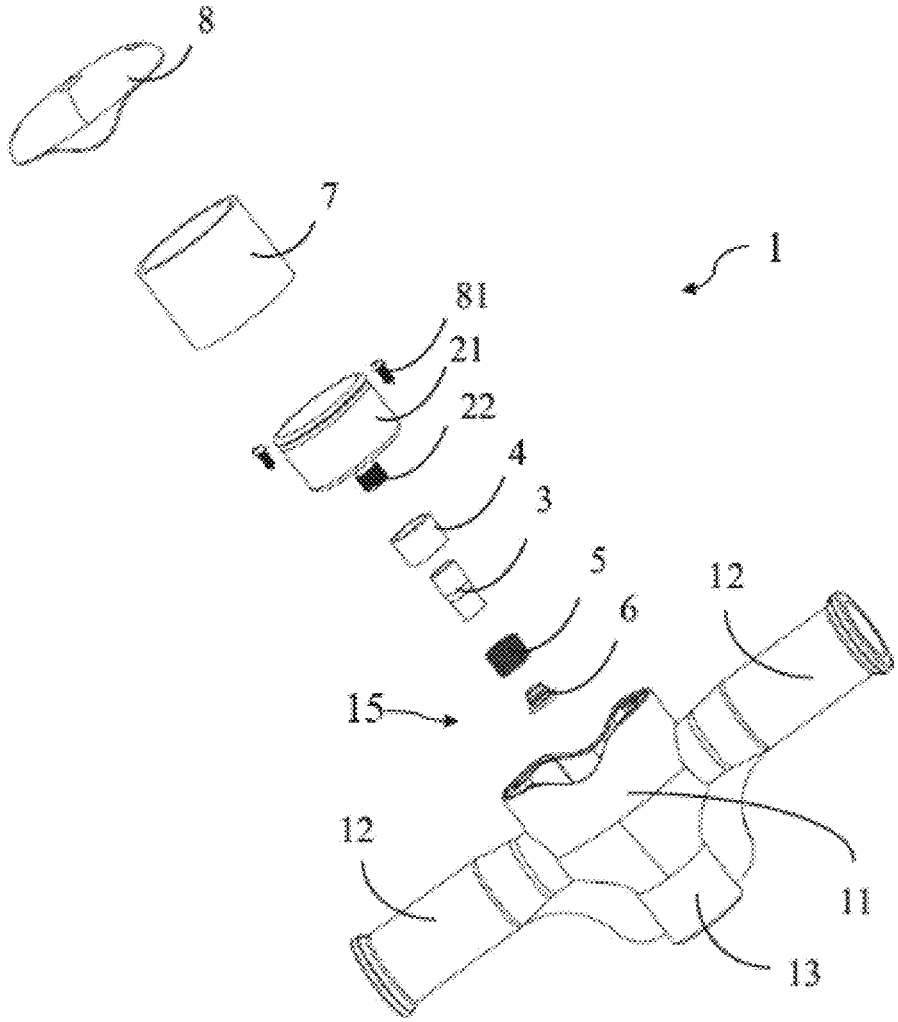
FIG. 2 is a disassembled rear perspective view of the hand air pump handle assembly in FIG. 1.

With initial reference to FIGS. 1 and 2, the handle shell 11 defines an internal accommodating space 111 for housing the pressure gauge 2. The handle shell 11 further defines an air vent 112 formed near the bottom of the accommodating space 111 to connect the accommodating space 111 to a pump body (not shown) of the hand air pump and a provided inflatable body (not shown and alternatively referred to as inflatable body). The inflatable body may comprise an air mattress, an inflatable sofa, a pneumatic tire, an inflatable toy, or any other item requiring inflation. The hand air pump handle assembly 1 further comprises a cover 8 fixed to the top of the handle shell 11 to close the accommodating space 111. The cover 8 may be fixedly connected to the handle shell 11 by fixing members, such as bolts 81. The cover 8 may include a transparent region through which a user can directly observe an air pressure value shown on the pressure gauge 2.

The two grip portions 12 extend oppositely from sides of the handle shell 11 for the user to grab with each hand while inflating. The first connector 13 extends through a the bottom of the handle shell 11 to connect the pump body of the hand air pump to the accommodating space 111 via the air vent 112. The second connector 14 is located between the handle shell 11 and the first connector 13 to connect the inflatable body via an external inflation tube (not shown). More particularly, one end of the inflation tube is connected to the second connector 14 and the other end of the inflation tube is connected to the inflatable body. As such, the inflatable body can communicate with the pump body and the accommodating space 111 via the air vent 112. The handle shell 11, the two grip portions 12, the first connector 13 and the second connector 14 are preferably integrally formed.

Figure 3:
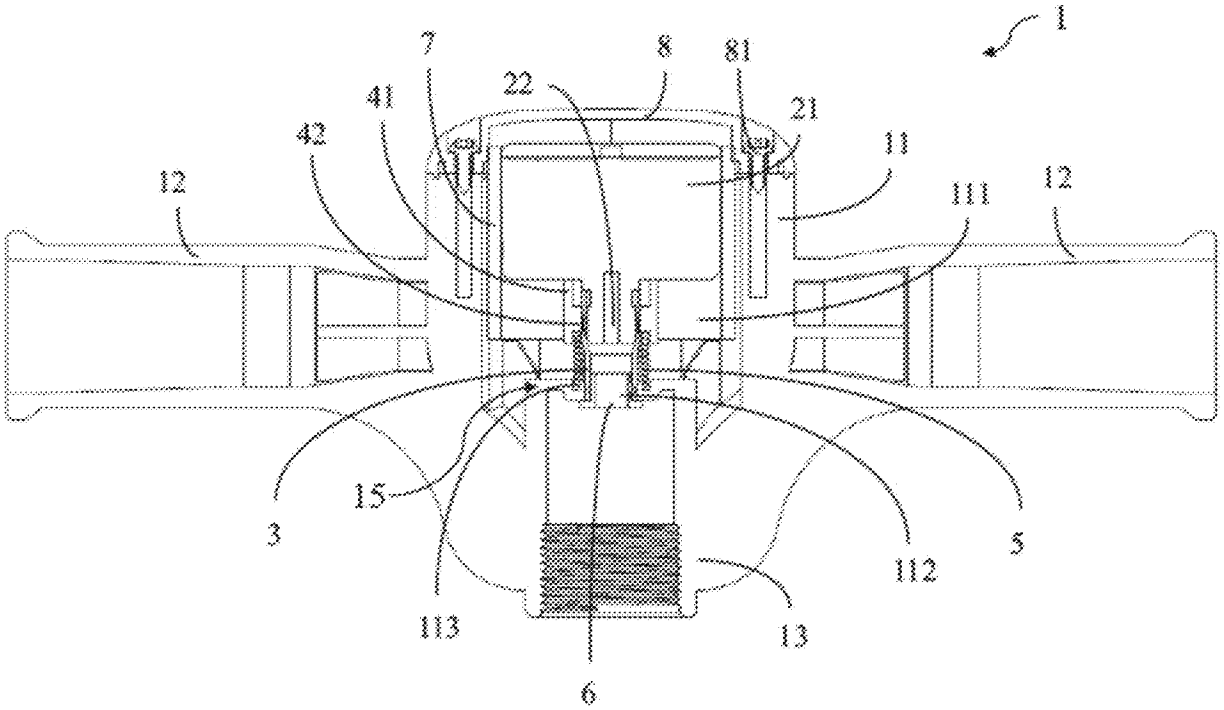
FIG. 3 is a cross-sectional view of the hand air pump handle assembly in FIG. 1 taken along a sectional line A-A.
Figure 4:
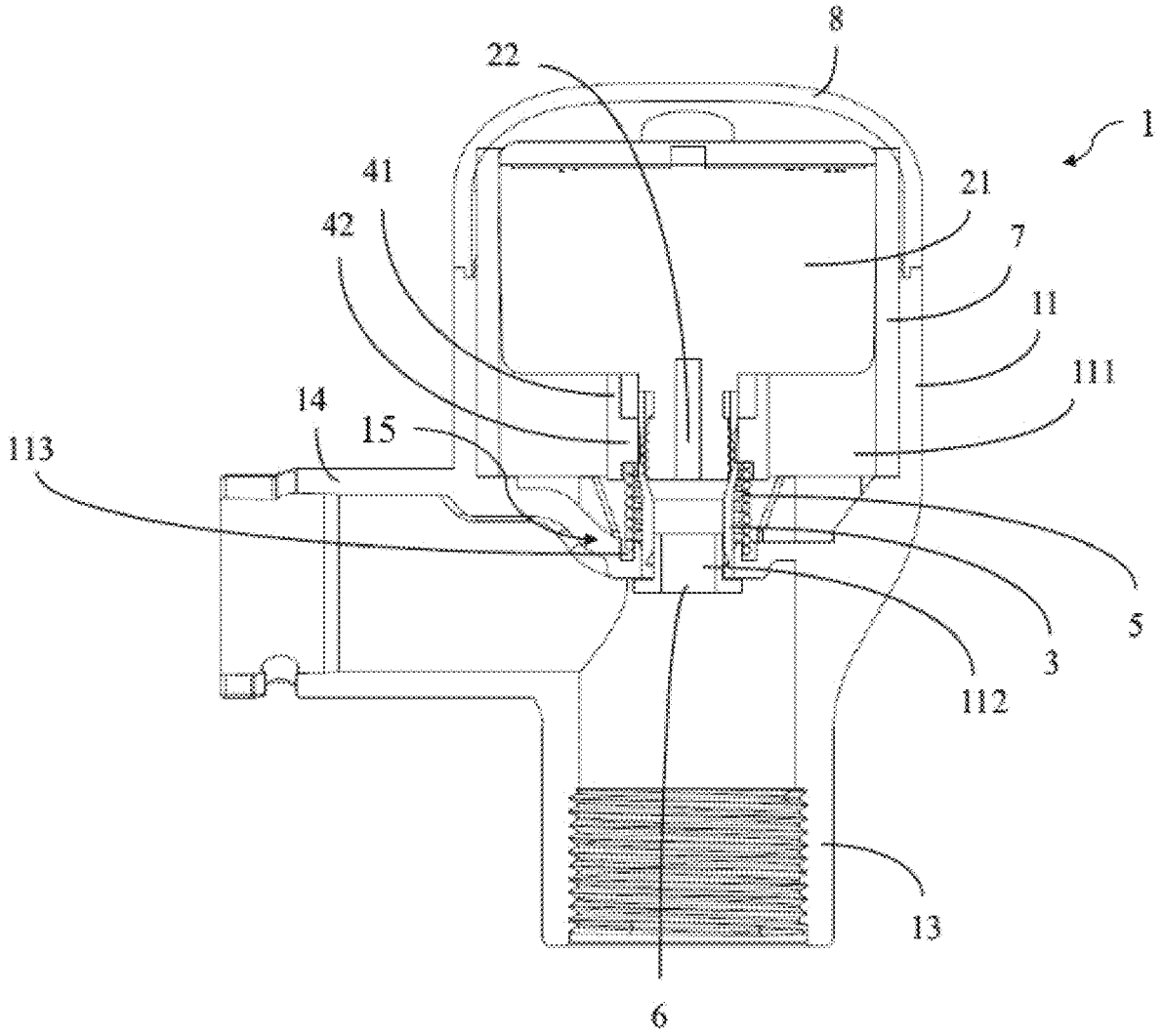
FIG. 4 is a cross-sectional view of the hand air pump handle assembly in FIG. 1 taken along a sectional line B-B.

As best illustrated in FIG. 3 and FIG. 4, the pressure gauge 2 is located in the accommodating space 111 and connected to the handle shell 11 by an elastic connector 15 that comprises materials and/or components that allow the pressure gauge 2 to move elastically within the accommodating space 111. The pressure gauge 2 comprises a pressure gauge body 21 and a pressure probe 22. The pressure probe 22 may include a metal probe with an external thread. The pressure probe 22 extends from the pressure gauge body 21 toward the air vent 112 and communicates with the inflatable body via a flexible connecting tube 3 (e.g., a silicone connecting tube). The flexible connecting tube 3 is at least partially located in the accommodating space 111 of the handle shell 11 and extends from the pressure probe 22 to the vent 112 in order to communicate the internal air pressure value of the inflatable body to the pressure gauge 2.

Figure 5:
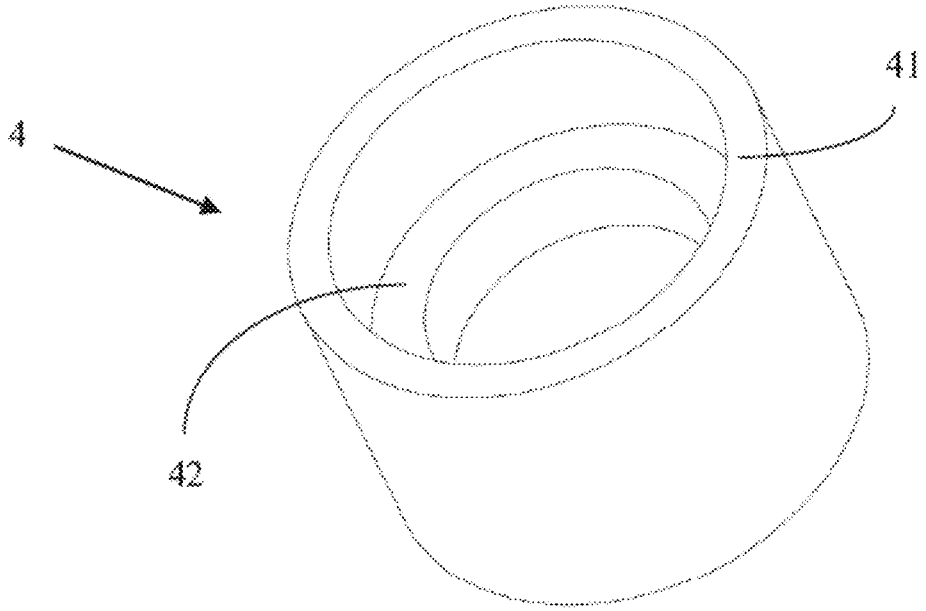
FIG. 5 is a perspective view of a resisting member of the hand air pump handle assembly in FIG. 1.

The elastic connector 15 includes a resisting member 4 and a spring 5 that enables the pressure gauge 2 to elastically travel a small dampened distance when under the impact of external forces. The resisting member 4 assists in the connection between the pressure gauge 2 and the flexible connecting tube 3. More particularly, the resisting member 4 is sleeved on an outer side of at least a portion of the flexible connecting tube 3. The resisting member 4 is illustrated in FIG. 5 and comprises a support portion 41 for supporting the pressure gauge body 21 and a raised portion 42 protruding radially inward along the support portion 41 to abut against the flexible connecting tube 3. The spring 5 is sleeved on the outer side of the flexible connecting tube 3 under the resisting member 4 opposite from the pressure gauge 2. An upper end portion of the spring 5 abuts a lower surface of the raised portion 42 of the resisting member 4, and a lower end portion of the spring 5 is fixed in an annular recess 113 surrounding the air vent 112 and formed in the handle shell 11. The spring 5 is biased to hold the pressure gauge 2 centrally within the accommodating space 111 and away from the handle shell 11.

The flexible connecting tube 3 extends between an upper end portion and a lower end portion. The upper end portion is fixed between the raised portion 42 and the pressure probe 22, and the lower end portion is fixed in communication with the air vent 112 through a tube joint 6. The tube joint 6 extends from the accommodating space 111 into the air vent 112. In the first embodiment, the upper end portion of the flexible connecting tube 3 is fixed by the abutment (such as by a pressure fit) between the raised portion 42 and the threaded pressure probe 22. With continued reference to the first embodiment, the lower end portion of the flexible connecting tube 3 forms an interference fit with the tube joint 6, such that it is fixed in the accommodating space 111 of the handle shell 11 and is in communication with the air vent 112 and pressure gauge 2.

The hand air pump handle assembly 1 may further include a flexible shock absorber 7 to further improve the impact resistance of the hand air pump handle assembly 1. The flexible shock absorber 7 may be arranged between the pressure gauge 2 and the handle shell 11 and may further at least partially cover the pressure gauge 2. In one arrangement, the flexible shock absorber 7 may be arranged around the pressure gauge body 21 such that it is located between the pressure gauge body 21 and the handle shell 11 to prevent the pressure gauge 2 from directly impacting the handle shell 11 under the influence of external force. The flexible shock absorber 7 may comprise of a rubber or a sponge-like material.

Figure 6:
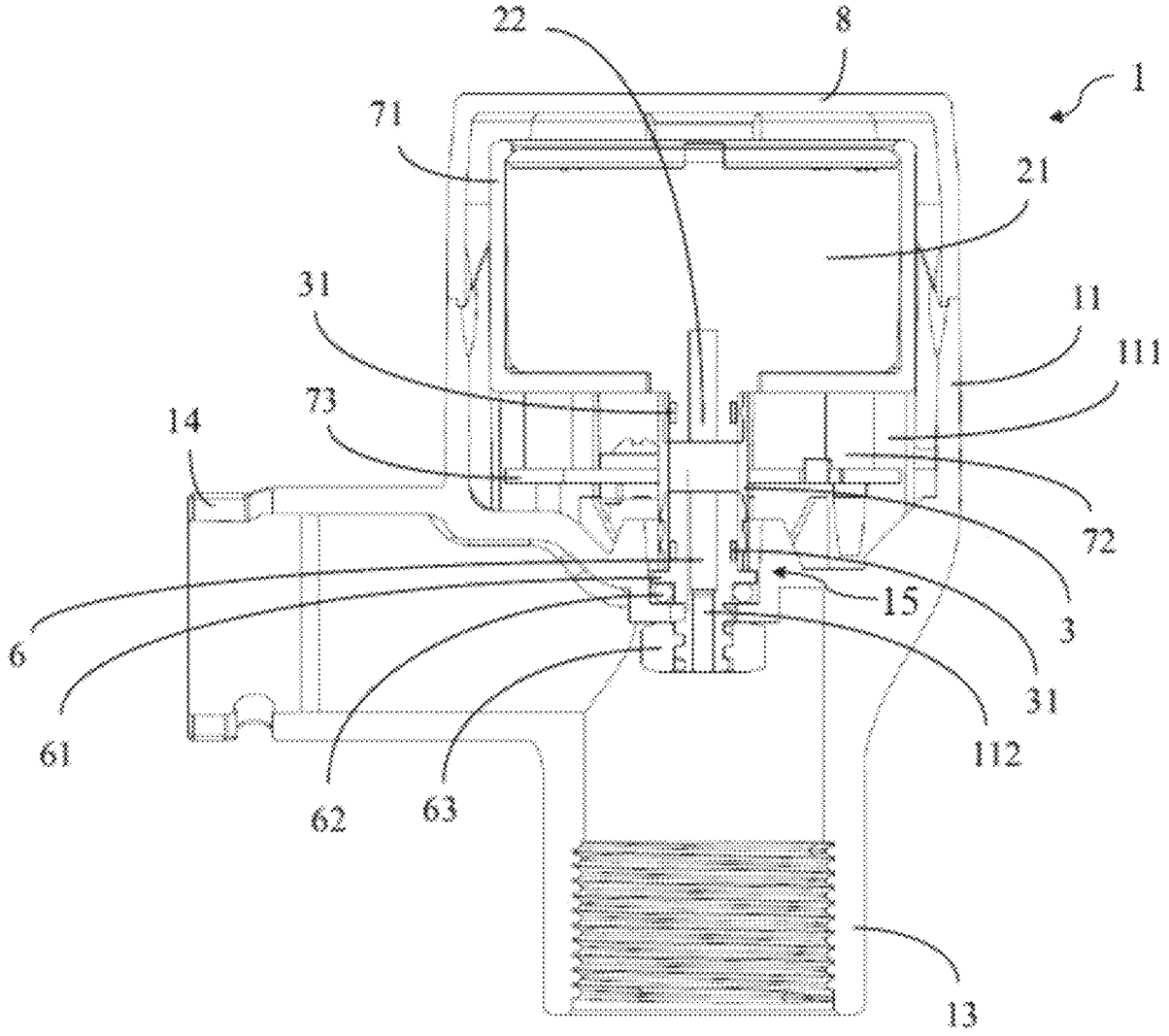
FIG. 6 is a cross-sectional view of the hand air pump handle assembly, according to a second embodiment of the present disclosure.

FIG. 6 illustrates a second embodiment of a hand air pump handle assembly 1. Unlike the first embodiment, the flexible connecting tube 3 in the second embodiment is fixed in place by at least one of a collar or a ribbon 31. More specifically, the upper end portion of the flexible connecting tube 3 is connected to the pressure probe 22 by a collar or a ribbon 31, and the lower end portion is connected to the upper end portion of the tube joint 6 by a collar or a ribbon 31. The tube joint 6 includes a lower end portion that is threaded and at least partially extends through the air vent 112 and is fixed to the handle shell 11 by a fixing member, such as a nut 63. The tube joint 6 may further comprise a protrusion 61 extending radially outward above the air vent 112 to assist in supporting the handle shell 11. More specifically, the protrusion 61 is located in the accommodating space 111 and extends a diameter of the tube joint 6 such that the diameter is larger than a diameter of the air vent 112 and cannot be removed therethrough. A seal washer 62 surrounding the tube joint 6 is further arranged between the protrusion 61 and the air vent 112 to prevent gas from leaking between the handle shell 11 and the protrusion 61, thereby ensuring that the pressure value detected by the pressure gauge 2 is more accurate.

With continued reference to FIG. 6, the flexible shock absorber 7 may further comprise a shock absorber body 71 that at least partially covers the pressure gauge 2 and at least one shock absorber leg 72 extending from the shock absorber body 71 towards the handle shell 11. The shock absorber leg 72 may further bias the pressure gauge 2 away from the handle shell 11. The hand air pump handle assembly 1 may further include a shock absorber holder 73 fixed in the accommodating space 111 of the handle shell 11 to support the at least one shock absorber leg 72. In one arrangement, the shock absorber body 71 covers the sides and a bottom of the pressure gauge body 21, and the shock absorber holder 73 is fixed in the accommodating space 111 by means of fixing members, such as bolts. The shock absorber holder 73 is thus located to support the at least one shock absorber leg 72 extending downward from the bottom of the shock absorber body 71. The at least one shock absorber leg 72 may include a plurality of shock absorber legs 72, for example, a pair of shock absorber legs 72.

The technical content and technical features of the present invention are disclosed herein, but it is understood that those skilled in the art may make various variations and improvements to the disclosed concepts under the creative idea of the present invention, and that all such variations and improvements fall within the scope of the present invention. The descriptions herein of the exemplary embodiments are illustrative and not restrictive, and therefore, the scope of the present invention is defined by the claims.

What is claimed is:

1. A hand air pump handle assembly, comprising:

a handle shell defining therewithin: an accommodating space, and an air vent in fluid communication with the accommodating space;

a pressure gauge disposed and elastically moveable within the accommodating space;

a flexible connecting tube disposed within the accommodating space of the handle shell, the flexible connecting tube comprising a flexible material having a cylindrical shape and comprising a first end, in an axial direction, connected to the pressure gauge and a second end, opposite the first end in the axial direction, connected to the handle shell; and a tube joint connecting the flexible connecting tube to the air vent of the handle shell.

2. The hand air pump handle assembly according to claim 1, further comprising:

an elastic connector connecting the pressure gauge to the handle shell, thereby permitting movement of the pressure gauge within the accommodating space;

wherein the pressure gauge comprises:

a pressure gauge body; and a pressure probe extending from the pressure gauge body and in fluid communication with the flexible connecting tube.

3. The hand air pump handle assembly according to claim 2, wherein the elastic connector comprises:

a resisting member at least partially sleeved over an outer side of the flexible connecting tube, the resisting member comprising a support portion for supporting the pressure gauge body and a raised portion protruding radially inward along the support portion to contact the flexible connecting tube; and a spring sleeved over the outer side of the flexible connecting tube and extending between a pair of ends thereof, wherein one end of the spring abuts against the raised portion of the resisting member, and the other end of the spring is fixed in an annular recess located around the air vent.

4. The hand air pump handle assembly according to claim 3, wherein the flexible connecting tube extends between the first end and the second end, wherein the first end of the flexible connecting tube is fixed between the raised portion of the resisting member and the pressure probe, and the second end of the flexible connecting tube forms an interference fit with the tube joint.

5. The hand air pump handle assembly according to claim 4, wherein the pressure probe includes a threaded portion extending through the raised portion of the resistance member and wherein the flexible connecting tube fits between the threaded portion and the raised portion.

6. The hand air pump handle assembly according to claim 1, further comprising a flexible shock absorber arranged between the pressure gauge and the handle shell for dampening impact between the handle shell and the pressure gauge.

7. The hand air pump handle assembly according to claim 6, wherein the flexible shock absorber comprises a shock absorber body at least partially covering the pressure gauge.

8. The hand air pump handle assembly according to claim 7, wherein the flexible shock absorber further comprises at least one shock absorber leg extending from the shock absorber body towards the handle shell to provide additional dampening.

9. The hand air pump handle assembly according to claim 8, further comprising a holder for the flexible shock absorber fixed in the accommodating space for contacting the shock absorber leg and causing the shock absorber leg to move as the pressure gauge is moved.

10. The hand air pump handle assembly according to claim 6, wherein the flexible shock absorber comprises a rubber member.

11. The hand air pump handle assembly according to claim 1, further comprising a cover that can be connected to and disconnected from the handle shell.

12. The hand air pump handle assembly according to claim 1, further comprising an inflatable body in fluid communication with the air vent, wherein the inflatable body comprises at least one of an inflatable sofa, an air mattress, an inflatable toy, and a pneumatic tire.

13. The hand air pump handle assembly according to claim 11, wherein the cover is at least partially transparent.

14. The hand air pump handle assembly according to claim 1, further including a pair of grip portions extending from opposite sides of the handle shell.

15. The hand air pump handle assembly according to claim 14, wherein the handle shell and the pair of grip portions are integrally formed.

16. A hand air pump handle assembly, comprising:

a handle shell defining therewithin: an accommodating space, and an air vent in fluid communication with the accommodating space;

a pressure gauge disposed and elastically supported within the accommodating space;

a flexible connecting tube disposed within the accommodating space;

a tube joint connecting the flexible connecting tube to the air vent; and a pair of cable ties, wherein one of the pair of cable ties affixes a first end of the flexible connecting tube to a pressure probe of the pressure gauge and another one of the pair of cable ties affixes a second end of the flexible connecting tube to the tube joint.

17. The hand air pump handle assembly according to claim 16, further including a fixing member affixing the tube joint to the handle shell.

18. The hand air pump handle assembly according to claim 17, wherein the tube joint further includes:

a protrusion located in the accommodating space that extends a diameter of the tube joint such that the diameter is larger than a diameter of the air vent; and a seal washer located between the protrusion and the handle shell.

19. The hand air pump handle assembly according to claim 18, wherein the tube joint is at least partially threaded and the fixing member includes a nut engaged thereon.

* * * * *